US005417610A

United States Patent [19]

Spransy

[11] Patent Number: 5,417,610

[45] Date of Patent: May 23, 1995

[54] METHOD AND DEVICE FOR REDUCING VORTICES AT A CLEANROOM CEILING

[75] Inventor: Peter Spransy, Salt Lake City, Utah

[73] Assignee: Daw Technologies, Inc., Salt Lake City, Utah

[21] Appl. No.: 973,067

[22] Filed: Nov. 6, 1992

[51] Int. Cl.[6] ..... F24F 3/16; F24F 7/007

[52] U.S. Cl. ..... 454/187; 55/355; 55/385.2; 55/484

[58] Field of Search ..... 55/484, 385.2, 355; 454/187, 243, 296

[56] References Cited

U.S. PATENT DOCUMENTS

| | | | |
|---|---|---|---|
| 3,158,457 | 11/1964 | Whitfield | 454/187 X |
| 3,173,616 | 3/1965 | Lipscomb | 454/293 X |
| 3,638,404 | 2/1972 | Mell et al. | 55/473 |
| 4,175,281 | 11/1979 | Lonseth | 362/148 |
| 4,693,175 | 9/1987 | Hashimoto | 454/187 |
| 4,776,263 | 10/1988 | Lokander et al. | 454/243 |
| 4,819,549 | 4/1989 | Gillingham et al. | 454/187 |
| 5,192,348 | 3/1993 | Ludwig | 454/187 X |

FOREIGN PATENT DOCUMENTS

| | | | |
|---|---|---|---|
| 138635 | 6/1987 | Japan | 454/187 |

OTHER PUBLICATIONS

Biocon, Inc. "Use of a Three Dimensional Anemometer for Evaluating Airflow Uniformity and Turbulence Intensity", 1992.

Manufacturer's Brochure "Pace Clean-TrakCeiling System".

Manufacturer's Specification "Pace Clean-Pak Clean-Trak" (Pat. Pend.).

*Primary Examiner*—Harold Joyce

*Attorney, Agent, or Firm*—Trask, Britt & Rossa

[57] ABSTRACT

A ceiling structure within a cleanroom, including an array of conventional HEPA filters supported in openings of a grid support structure, wherein the ceiling structure includes a gel track coupled near a lowest interior perimeter of each of the openings of the grid support structure. HEPA filters including a peripheral flange are suspended in the ceiling structure by having a ceiling edge of the peripheral flange immersed in the gel track in near proximity with the ceiling level. An inclined channel is formed along an inclined wall of the gel track such that a downward extension of the inclined wall projects into the vortex region under the grid support structure. Filtered air passing from the HEPA filter is then directed into this flow channel at a sufficient rate of speed to flush the particulate contaminate from the vortex region.

23 Claims, 3 Drawing Sheets

METHOD AND DEVICE FOR REDUCING VORTICES AT A CLEANROOM CEILING

FIELD OF THE INVENTION

The invention relates to cleanroom construction and particularly to cleanroom ceilings and frames therefor, including the mounting of ceiling panels and/or HEPA air filters on supporting beams or cross members and the suspension of lighting fixtures, wire conduits, or other hardware from the cross members between the filters. More particularly, the present invention pertains to flush mounted ceiling structure which reduces the vortex formed below the cross members and enables use of a wider cross member for receiving flush light systems within the ceiling.

BACKGROUND OF THE INVENTION

Continuing advancements in the electronics industry have imposed ever more rigorous purity requirements on cleanrooms where sensitive components are manufactured. Several years ago, class 100 cleanrooms (averaging no more than 100 particles of 0.5 microns diameter in one cubic foot of controlled air space) were acceptable, while requirements today often exceed class 11 based on 0.1 micron diameter particles. See, for example, prior art patents disclosing cleanroom structures include U.S. Pat. Nos. 3,158,457; 3,638,404; 4,667,579 and 4,693,173. Cleanroom ceilings, walls, and floors must therefore be constructed in such a manner as to minimize convection and eddy currents, dead air spots, and other areas which tend to collect dust and other particulate matter and/or disturb the uniform air flow in the cleanroom. Because of the moving air within the cleanroom, both convection currents and dead spots tend to form small, swirling pockets of air near the ceiling, referred to herein generally as vortices. These pockets capture particulate material and accumulate this contaminant, leading to breach of the class requirements for the cleanroom.

Generally, cleanrooms are adapted for generating uniform flow of filtered air from the ceiling to and through the floor. The air flow originates from blowers mounted above the ceiling on a support structure. The air from the blowers is forced through HEPA air filters forming the ceiling of the cleanroom and travels downwardly from the ceiling through the cleanroom, exiting through the floor. The ceiling filters are generally mounted on a grid of ceiling support beams or cross members, the bottom surfaces of which are in close proximity with the bottom surfaces of the filters.

Although the diffusion screen assists in developing laminar flow of the air exiting the filters, the desired uniform flow pattern is interrupted immediately below the ceiling surface by vortex regions beneath the cross members. These vortex regions form because of low pressure arising below the cross members in the absence of air flow, causing a dead space where particulate material can accumulate. The actual size and geometry of the vortex will vary, depending upon the width of the cross member and the velocity of air flow emanating from the adjacent filters.

The uniform flow pattern can also be disturbed by light fixtures and other attachments which are suspended from the cross members. For example, the high intensity lighting systems used in cleanrooms generally comprise extended linear arrays of fluorescent light tubes traversing the width and/or length of the cleanroom ceiling. The bottom surfaces of the support beams generally are used for the attachment of these light fixtures and are also used to attach mounting apparatuses for supporting modular walls and similar hardware. These attachments extend into the cleanroom from the ceiling plane formed by the ceiling filters and beams, creating convection currents and collection points for dust and other particulate matter which impair the purity of the cleanroom.

Efforts to place these light fixtures within the cross members have been frustrated by the need for minimizing the vortex by reducing the width of the cross member. Placement of the light fixture within the cross member would necessarily increase this width in order to provide adequate volume to fully contain the fixture. Accordingly, general practice continues to apply a tear drop configuration of lights which suspends the fixture below the cross member.

Nevertheless, the increasingly stringent requirements for minimal contamination within the cleanroom will likely necessitate modification of cleanroom ceiling structure to a flush mounted system. Brod McClung-Pace Co has introduced a flush ceiling system illustrated in FIG. 2 which depicts a widened cross member 10 having an enlarged channel 11 for receiving a light fixture 12. A gel track 13 supports HEPA filters 14 in a position located above the channel 11. Pace has attached a screen member 15 below the filter 14 in a manner which is represented to have reduced the vortex region 16 under the cross member to within 2 inches of the flush surface 17. Normally, a vortex will extend 3 to 4 times the grid width. The actual depth of the vortex associated with the Pace design is suggested to be only one-half the distance between adjacent filters. Accordingly, a separation distance between filters of 4 inches would result in a vortex region of two inches in depth. Although a two inch vortex may represent an improvement over the prior art, it still poses a formidable limitation to obtaining a desirable level of air purity for future cleanroom systems. In addition the Pace structure creates a new problem of air turbulence which is unresolved for the first seven to eight feet below the ceiling. This arises from the large openings around the periphery of their screen. These appear to generate enough turbulence to disturb laminar flow along this substantial length.

An additional area of concern with the Pace configuration is the placement of the gel track 13 above the cross member 10. This construction permits migration of particulate matter within lateral spaces 18. Not only does this present the possibility of contamination leakage to the cleanroom, but it operates to complicate actual detection of the leak location. Indeed, particles may travel several meters within the interconnecting channels 18 before escaping to the cleanroom interior. Although detection of this point of escape may be a simple procedure, the actual internal source of the leak may be very difficult to isolate.

On the other hand, placement of the respective gel tracks on opposite sides of the cross member would widen the separation space between filters as much as one inch. This would tend to lengthen the vortex region under traditional ceiling structure another 3 to 4 inches below the cross member. Therefore, the industry is caught in a balancing act of (1) placement of gel tracks above the cross member in order to narrow the separation distance between filters and (2) placement of the gel tracks at the base of the cross members to minimize contamination from migrating particles flowing within the ceiling structure, such as within open spaces 18. Neither choice offers the desired minimization of migration of contaminant particles. In one instance, migration occurs within passages of the ceiling support system. In the other case, the migration extends along a vortex located at the lower surface of the cross member or light fixture within the cleanroom.

As a further point of concern, no suitable arrangement of cleanroom ceiling fixture attachments has yet been developed which maximizes uniformity of non-contaminated air flow while at the same time offering compatibility with conventional cleanroom ceiling structure such as conventional HEPA filters with a lower mounting flange or knife edge positioned at the base of the filter. Note that the Pace "under slung" structure requires use of a special filter 14 whose mounting flange 15 is positioned at an upper portion 19 of the filter. Such compatibility with conventional low mounting flange or knife edge structure is not only important from a viewpoint of economy in construction, but the conventional filter with lower mounting flange offers a known advantage of better sealing which is known and trusted within the industry. Accordingly, the use of conventional HEPA filters avoids the formidable challenge of having to re-educate the market as to the acceptability of new filter structure, compared to that which is known and accepted.

Neither has such a system been developed for general use with flush lighting systems in ceilings of non-cleanroom environments, e.g., Lonseth, U.S. Pat. No. 4,175,281, Lipscomb, U.S. Pat. No. 3,173,616. To date, applicant is aware of no suitable fixture arrangement which has been developed which satisfies the specific requirements of a cleanroom, including minimizing the negative impact of vortex formation below the cross members without development of strong turbulence.

OBJECTS AND SUMMARY OF THE INVENTION

It is an object of the invention to minimize interference with uniform filtered air flow through a cleanroom by making its lower ceiling substantially flat.

It is yet another object of this invention to place all light fixtures of the cleanroom within cross members of the ceiling structure to accommodate mini-environments and wafer transport systems mounted near the substantially flat ceiling.

A further object of the present invention is to provide a flush mounted ceiling structure which includes diffusion screens with peripheral flow channels under the filters to improve laminar flow and minimize vortex formation.

These and other objects are realized in a ceiling structure within a cleanroom which includes an array of standard HEPA filters supported in openings of a grid support structure. A gel track is coupled near a lowest interior perimeter of each of the openings in the grid support structure approximately flush with an exposed surface of the HEPA filters to the cleanroom interior. Each of the HEPA filters includes a peripheral flange or knife edge coupled near the exposed surface of the HEPA filters and includes a sealing edge suspended within the gel track in approximate alignment with the ceiling level. Means are provided for flushing a vortex space immediately below the grid support structure and between the respective openings of the grid structure with a channeled air stream to remove particulate contaminant.

These objects are also embodied in a method for removing particulate material from a vortex space immediately below cross members forming a grid matrix which supports HEPA filters above a cleanroom enclosure. This method involves the steps of a) suspending the HEPA filters within openings of the grid matrix and between cross members by placing a peripheral support flange of the HEPA filters in a gel track support channel attached at a base side of the cross members; b) positioning a screen below the HEPA filter to form a collection chamber between the screen and filter; c) forming an inclined perimeter channel around a periphery of the screen and between the gel track support channel, said channel being directed toward the vortex below an adjacent cross member; and d) forcing air through the HEPA filter and into the collection chamber, with a primary directional element of air flow being aligned with the channel and passing from the inclined channel into the vortex space.

Other objects and features of the present invention will become apparent to those skilled in the art, based on the following detailed description, taken in combination with the accompanying drawings, in which.

DETAILED DESCRIPTION OF PREFERRED EMBODIMENT

Figure 1:
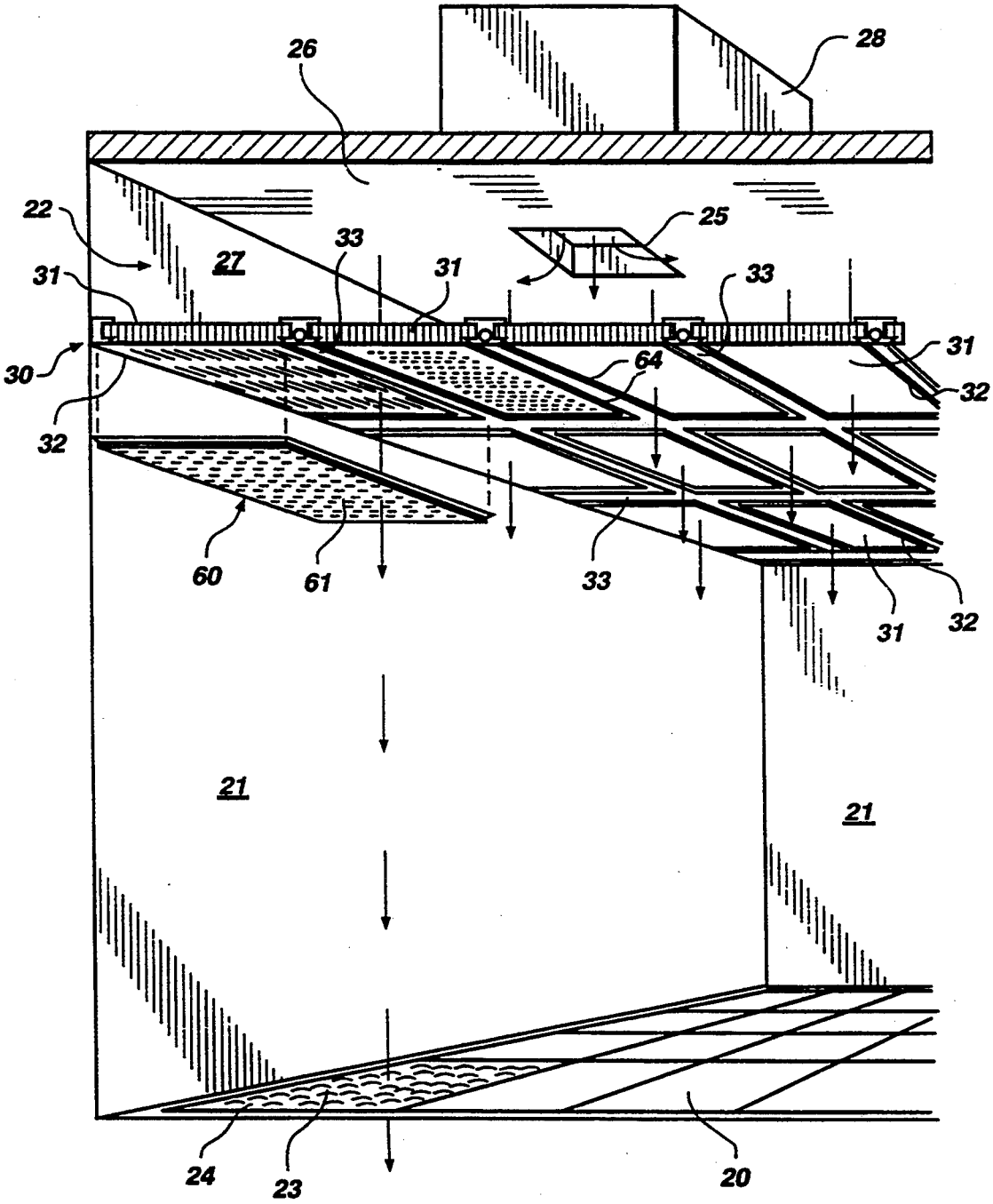
FIG. 1 shows a cutaway, perspective view of a cleanroom enclosure depicting a flush light mounted ceiling with a HEPA filter system constructed in accordance with the present invention.
Figure 2:
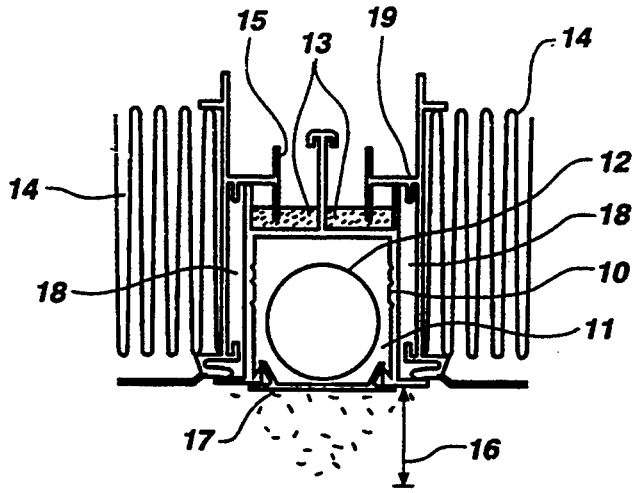
Fig. 2 (PRIOR ART)
FIG. 2 depicts a cross section of prior art construction illustrating the occurrence of vortex regions under cross members of a ceiling support grid.

FIG. 1 illustrates a cleanroom of conventional enclosure including floor structure 20, side walls 21 and an overhead plenum 22. The floor structure 20 is a grid construction which is vented to allow air flow therethrough. This air flow may either be recirculated to the plenum or exhausted to the atmosphere. Although openings 23 are shown in only one grid section 24 it is to be understood that in general applications, all grid sections will provide for venting of air to facilitate a uniform, laminar air flow pattern from the plenum 22 to and through the floor 20.

Plenum 22 and side wall construction has not been detailed, but merely represents conventional enclosure structure which provides maximum sealing to achieve desired cleanroom conditions. This enclosing structure may be either floor supported or otherwise suspended. The plenum 22 receives air through a plenum opening 25 which may either be in the top covering 26 or in lateral walls 27. In the interest of simplicity, other structures applied within the plenum 22 for support and for dispersion of air flow have not been shown. For example, a baffle plate or other air distribution structure would typically be positioned within the plenum to provide dispersion of air pressure throughout the plenum volume. An air handling unit 28 is coupled to the opening 25 and supplies air to pressurize the plenum. Hereagain, numerous systems for air control are available and may be applied with conventional techniques to service a cleanroom in accordance with the present invention.

A flush mounted ceiling structure 30 includes an array of HEPA filters 31 which are supported in openings 32 of a grid support structure 33. The details of construction for the grid support structure and its associated components making up the cleanroom ceiling are shown more clearly in FIG. 3.

Figure 3:
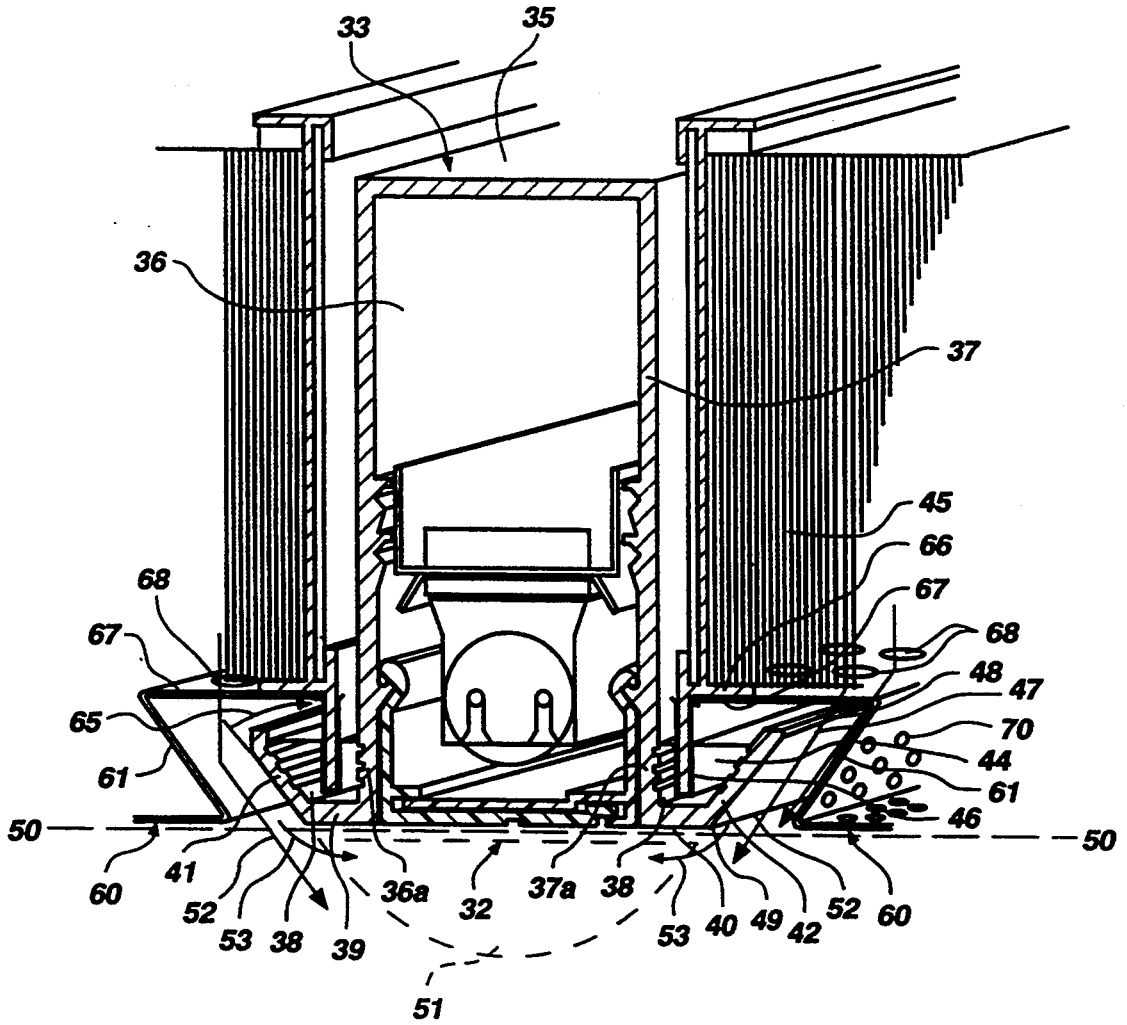
FIG. 3 illustrates a cross section of the flush construction of the cross members of the ceiling of FIG. 1, providing an enlarged view of the structure for attaching HEPA filters to the cross members in combination with a diffusion screen.

The cross members 33 form a grid matrix and supply the load bearing component to support the total ceiling structure 30, including the HEPA filters which are suspended within the grid openings 32. Typically, these cross members which make up the grid support structure are extruded sections of aluminum which are rigidly interconnected and have a structural configuration and load bearing capacity to support the illustrated ceiling structure. Specifically, the embodiment illustrated in FIG. 3 provides a cross member having a top wall 35 and opposing side walls 36 and 37. These side walls extend down to a gel track 38 which is formed between the lowest portions 36*a* and 37*a* of the cross member side walls 36 and 37. These lowest portions 36*a* and 37*a* are joined with base sides 39 and 40 and opposing side walls 41 and 42.

This gel track 38 is accordingly coupled to the cross member by being integrally formed as a single extrusion with the side walls 36 and 37 near a lowest interior perimeter of each of the openings 32 in the grid support structure. The configuration of the gel track and its positioning near the lowest interior perimeter of the openings enables an approximate flush configuration to the interior ceiling of the cleanroom.

The function of the gel track 38 is to provide a trough for containment of a sealing gel which receives a peripheral flange or knife edge 44 which is coupled to and supports the HEPA filter material 45. This peripheral flange 44 includes a sealing edge 46 which is suspended within the gel track in near proximity with the ceiling level 50.

In the preferred embodiment, the inside, side walls 36*a* and 37*a* form a vertical extension of the respective sidewalls 36 and 37 and provide a mounting base for integral attachment of the base side 39, 40 and remaining sidewalls 41 and 42. These remaining sidewalls 41 and 42 will hereafter be referred to as inclined sidewalls for reasons which will be disclosed hereafter.

The inclined sidewalls 41 and 42 define an interior perimeter for the respective openings 32 of the grid support structure. Specifically, the inclined sidewalls 41 and 42 not only provide enclosing structure for the gel track 38, but also provides a wall face 47 which is inclined from a top edge of the side wall 48 to a bottom edge of the sidewall 49, where the respective sidewalls 41 and 42 form a juncture with the base sides 39 and 40. It is this inclined structure which provides means for flushing a vortex space or region (referred to hereafter as vortex) 51. As indicated previously, this vortex is formed immediately below the grid support structure and between respective openings of the grid structure where downward air flow does not occur by reason of the impermeable nature of the extruded aluminum support structure.

The specific purpose for the inclined sidewall face 44 is to provide means for generating a stream of air flow 52 toward this vortex 51 which effectively sweeps particulate matter into a desired laminar flow with the remaining air flow generated through the grid openings. The sidewall face 44 is inclined to the extent that its downward extension projects into the vortex 51.

The inclined sidewalls 41 and 42 provide an important and primary directional element of air flow from the filter. In conventional systems, air is directed downward from a filter, either directly into the cleanroom or through a diffusion screen. Although some lateral movement of air will extend below the cross member in a conventional system, a substantial vortex remains which captures tiny particulate matter which ultimately can contaminate critical items manufactured in the cleanroom.

The inclined sidewall of the gel track provides a partial lateral path of movement substantially parallel with the primary directional element and by which filtered air is conducted toward the vortex region. This air may move also at high speed such that its entrance past the base side 39 and 40 creates a marginal low pressure zone which draws air directly into the vortex (see line 53, FIGS. 3 and 4), greatly increasing the sweeping effect which can flush this vortex of particulate material. This is in direct contrast to air flow which may be diverging from the filter or through a screen partially into this vortex, but without any significant low pressure action to maximize this flushing action.

Accordingly, in the preferred embodiment which employs a diffusion screen, the screen structure 60 is configured at its perimeter with a similar and opposing inclined wall 61 which functions to direct the air stream 52 from the filter toward the inclined sidewall and into the vortex.

The specific construction of the screen identified as item 60 in FIGS. 1 and 3 is as follows. A large planar section 61 of the screen has a uniform dispersion of perforations which enhance the laminar flow of air exiting the air filter. This planar portion is not unlike conventional diffusion screens which provide a similar function. This planar portion is substantially flush with the ceiling level, which also conforms to the base side of the grid support structure.

It will be noted from FIG. 1 that each grid section within the ceiling includes what appears to be a surrounding slot 64 which represents the air flow channel 52 defined between the inclined sidewalls 41 and 42 and the inclined peripheral edge of the screen member 60. Specifically, this peripheral edge for the screen includes a first peripheral flange 61 which extends upward from the screen and is configured to direct the air stream from the filter into and along the inclined sidewalls 41 and 42. In the preferred embodiment, this peripheral flange for the screen member is inclined at a common angle with the inclination of the inclined sidewalls 41 and 42. As shown in FIG. 1, the channel formed between these two elements gives the appearance of the slotted channel previously noted around each screen member. Air flow emanating from this channel flows into the vortex 51, sweeping particulate material away and reducing occurrence of a vortex.

The range of inclination angles for this flow channel will vary, depending upon the width of the cross members and lower vortex region 51. A general preferred range lies within 40 to 70 degrees with respect to the vertical axis, with a preferred angle of inclination between approximately 50 to 60 degrees. This angular range is represented by item 65.

The screen is mounted with respect to the gel track and filter support structure 66 by means of a second peripheral flange 67, forming a "Z" configuration. This second peripheral flange 67 extends laterally from the first peripheral flange to provide a support plate which can be coupled to the filter support structure 66 by a clip or other removable means of attachment. This enables the screen to be suspended from the grid support structure in flush relationship with the ceiling, approximately at the ceiling level 50 and removed from the room side of the filter.

Air flow into the flow channel between the gel track and screen may be provided through openings 68 in the second peripheral flange. Generally, these openings provide a nozzle effect with greater air flow capacity than the perforations across the general surface of each screen to favor a higher velocity of air flow through this flow channel, thereby creating the low pressure zone which draws air flow into the vortex. As this air flow expands into this vortex region, its air speed decreases, enabling it to assume a laminar flow speed consistent with the general laminar flow of air from the ceiling diffusion screens to the floor. It has been noted that flow speed through the channel may be adjusted to match general laminar flow rates and still solve most of the vortex problem. This has the benefit of minimizing turbulence that can otherwise result if air flow rate below the cross members substantially exceeds general laminar flow rates.

Additional lateral force may be supplied to this air flow stream by the use of openings 70 through the first periphery. When the screen operates to form a collection chamber between the filter 45 and the perforated screen material 60, a higher pressure is realized than that which exists within the cleanroom. This higher pressure can be utilized to direct a lateral air stream through the first peripheral flange and its openings 70, thereby enhancing the inward flow pattern 52 which is otherwise created by the low pressure zone effect below the cross member. In accordance with this embodiment, lateral air flow is provided into the flow channel, further directing this air flow toward the vortex region. Hereagain, the size of openings through the first peripheral flange will be dependent upon the degree of deflection desired in the primary air stream which flows between the gel track and first peripheral flange of the diffusion screen. It is believed that the openings in the second flange will generally be larger than those in the first peripheral flange to ensure that adequate velocity in the air stream creates the desired low pressure zone effect to draw air flow into the vortex immediately below the cross member.

Figure 4:
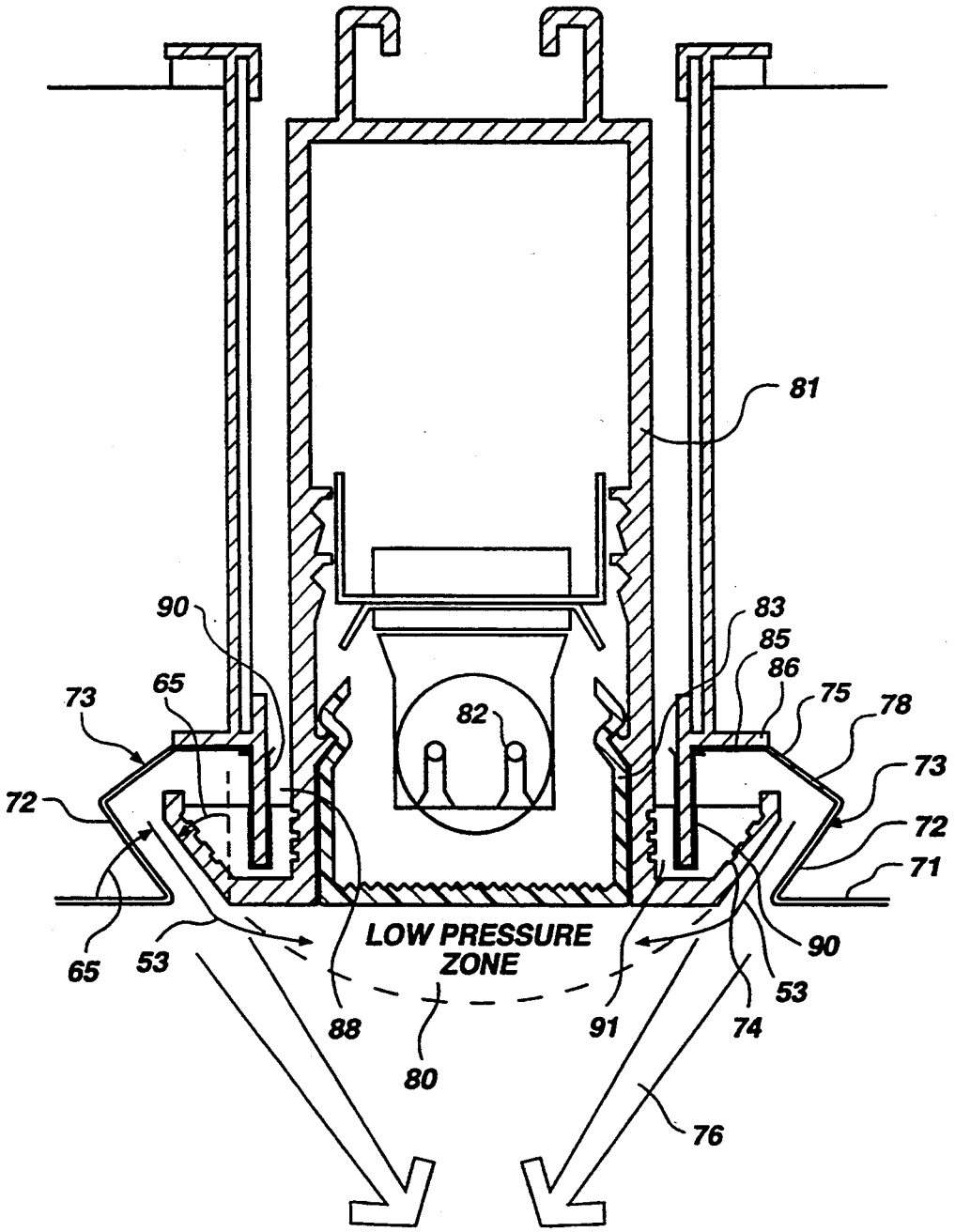
FIG. 4 depicts an alternate embodiment of a cross section of a cross member and associated peripheral screen structure.

It will be apparent to those skilled in the art that other geometric configurations for the first and second peripheral flanges 61 and 67 can be developed in contrast to the Z configuration illustrated in FIG. 3. For example, FIG. 4 shows a perimeter wall structure 73 which provides an angled Z configuration. This angled Z is formed at its base by the perforated screen 71 and couples to a first perimeter wall 72 of the screen which is substantially parallel with the inclined wall 74 of the gel track. The space between the first perimeter wall 72 and inclined wall 74 forms the flow channel as previously discussed. The remaining angled Z structure includes a section of screen wall 75 comprising an upper inclination which is approximately normal with a direction of air flow 76 through the inclined flow channel. This upper inclination 75 includes large openings 78 of sufficient size and configuration to provide a higher rate of air flow into the inclined flow channel than that which passes through the perforated screen 71 and into the cleanroom. These openings may be elongated, elliptical openings similar to that shown in FIG. 3 as item 68, or may be of other geometries which supply the desired rate of air flow for establishing a low pressure region 80 immediately below the cross member 81 and attached light fixture 82 and cover plate 83. It will be noted that the embodiment illustrated in FIG. 4 provides approximate perpendicular relationship between the second inclined perimeter sidewall 72 and the upper inclination 75. Hereagain this second incline sidewall 72 may have perforated openings to provide lateral force for urging the air flow further toward the low pressure zone area 80.

A final portion of the angled Z perimeter structure includes a peripheral support flange 85 which is coupled at a remaining edge of the upper inclination 75, projecting laterally therefrom. This peripheral support flange is configured for attachment to perimeter support structure 86 of the HEPA filter. Such attachment may be by means of a clip (not shown) or other mechanical means of removable attachment.

As with the previous embodiment shown in FIG. 3, this construction may be applied to develop a collection chamber within the space below the HEPA filter and above the screen 71. This collection chamber cooperates with the peripheral flange structure 72 and 75, and openings 78 to direct air flow toward the vortex space with sufficient velocity to create the desired low pressure zone 80 which pulls air flow through the vortex region below the cross member 81.

These representative structures showing various embodiments of the present invention may be utilized as part of a method for removing particulate material from a vortex space immediately below cross members 33 and 81 which form a grid matrix useful for supporting standard HEPA filters above a cleanroom enclosure. The method involves the steps of, first, suspending and sealing the HEPA filters within openings 32 and 88 of the grid matrix and between cross members 33 and 81 by placing a peripheral support flange or knife edge 47 and 90 of the HEPA filters in a gel track support channel 38 and 91 attached at a base side of the cross members. The next step involves positioning a screen 71 below the HEPA filter to form a collection chamber between the screen and filter. Next, an inclined perimeter channel is formed between a periphery of the screen 73 and the gel track support channel 91, the inclined perimeter channel being directed toward the vortex below an adjacent cross member. The method is completed by forcing air through the HEPA filter and into the collection chamber, with a primary directional element of air flow being aligned with the channel and passing from the inclined channel into the vortex space.

It is to be understood that the disclosure of specific embodiments and methods set forth in this specification are not intended to be limiting to the scope of the invention as set forth in the following claims.

I claim:

1. A ceiling structure within a cleanroom, including an array of HEPA filters supported in openings of a grid support structure, said ceiling structure including:

a gel track coupled near a lowest interior perimeter of each of the openings in the grid support structure approximately flush with an exposed surface of the cleanroom interior ceiling, said gel track including a channel having an open top side, enclosing side walls and a base side, one of said side walls including an interior side wall which is inclined from a top edge to the base side;

said HEPA filters including a peripheral flange coupled near the exposed surface of the HEPA filters and having a sealing edge suspended within the gel track in near proximity with the ceiling level;

a diffusion screen positioned across the opening of the grid support structure and substantially flush with the ceiling level, said screen including a first peripheral flange extending upward from the screen at an angle of inclination approximately equal to the inclination of said interior side wall and said first peripheral flange being displaced from the interior side wall, said first peripheral flange and said inclined side wall forming an air flow channel therebetween for directing a stream of air into a vortex positioned immediately below the grid support structure to remove particulate contaminant from said vortex;

and means for directing the air stream from the HEPA filter toward said interior side wail and into said vortex.

2. A structure as defined in claim 1, wherein a second peripheral flange extends laterally from the first peripheral flange to provide a support plate for suspending the screen from the grid support structure in flush relationship with the ceiling.

3. A structure as defined in claim 2, wherein the second peripheral flange includes openings which permit air flow from the HEPA filter into the air flow channel.

4. A structure as defined in claim 3, wherein both the second and first flanges include openings to permit air flow from the HEPA filter into the air flow channel.

5. A structure as defined in claim 4, wherein the openings in the second flange provide a greater air flow rate than the openings in the first flange.

6. A structure as defined in claim 5, wherein the angle of inclination for the inclined side wall is inclined at an angle within the range of 40 to 70 degrees with respect to a vertical orientation.

7. A structure as defined in claim 6, wherein the angle of inclination for the inclined side wall is approximately 50–60 degrees.

8. A cleanroom ceiling comprising an array of HEPA filters supported within a grid support system, said grid support system including:

a grid matrix of load beating cross members which are rigidly interconnected to provide load bearing support to a cleanroom ceiling structure, said cross members defining filter insert openings between adjacent cross members;

a gel track support channel attached at a base perimeter of each said filter insert opening with a channel opening oriented upward to receive a filter support flange within the gel track support channel;

said support channel including channel means for directing air flow from the HEPA filter to a vortex space immediately below the adjacent cross member to sweep particulate matter from the vortex into a downward air movement;

said channel means including an inclined channel which diverts air flow from a vertical, downward path of movement into a partial lateral path of movement oriented toward the vortex space under the adjacent cross member;

a screen positioned below the filter opening and approximately flush with a bottom surface of the cross member, said channel means including a perimeter wall of the screen; and the perimeter wall of the screen forming a second, opposing side wall of the inclined channel which diverts air flow into the vortex space.

9. A structure as defined in claim 8, wherein a side wall of the inclined channel is formed by an inclined side wall of the gel track support channel.

10. A structure as defined in claim 9, wherein the inclined side wall of the support channel is inclined with respect to a vertical axis within a range of 40 to 70 degrees.

11. A structure as defined in claim 8, wherein the screen includes openings within the perimeter wall of the screen, the openings within the perimeter of the screen and a geometry of the perimeter are configured to develop a nozzle effect which supplies a higher rate of air flow into the inclined channel and toward the vortex space as compared to an air flow generally directed downward through said remaining ceiling portion of the screen.

12. A structure as defined in claim 11, wherein the configuration of the perimeter wall of the screen includes an upper section which is oriented approximately normal to a direction of air flow through the inclined channel, and said upper section including perimeter openings of sufficient size and configuration to provide said higher rate of air flow through the inclined channel and into the vortex.

13. A structure as defined in claim 12, wherein the second inclined side wall of the channel forming part of the perimeter of the screen is at approximately perpendicular orientation with respect to the upper inclination.

14. A structure as defined in claim 13, wherein the upper inclination of the perimeter of the screen includes a peripheral support flange projecting toward the cross member laterally toward the cross member and being configured for attachment to perimeter support structure of the HEPA filter.

15. A structure as defined in claim 8, wherein the screen encloses a collection chamber below the HEPA filter which cooperates with the channel means for directing air flow toward the vortex space for minimizing entrapment of particulate material within the vortex space.

16. A method for removing particulate material from a vortex space immediately below cross members forming a grid matrix which supports HEPA filters above a cleanroom enclosure, said method comprising the steps of:

a) suspending the HEPA falters within openings of the grid matrix and between cross members by placing a peripheral support flange of the HEPA filters in a gel track support channel attached at a base side of the cross members;

b) positioning of a screen below the HEPA filter to form a collection chamber between the screen and filter;

c) forming an inclined perimeter channel between a perforated, upstanding periphery edge of the screen and the gel track support channel, said inclined perimeter channel being directed toward the vortex below an adjacent cross member; and d) forcing air through the HEPA filter and into the collection chamber, with a resultant air flow passing into the inclined channel as compared to passing vertically downward through the screen.

17. A method as defined in claim 16, further comprising the step of adjusting air flow rates through the inclined perimeter channel such that a higher speed of air flow occurs in the channel as compared to air flow passing through the screen.

18. A method as defined in claim 16, further comprising the step of adjusting air flow rates through the inclined perimeter channel such that air flow rates emerging immediately below the vortex space substantially match air flow rates passing through the screen.

19. A ceiling structure in a cleanroom comprising:

a grid support structure including a cross member, said grid support structure defining at least one opening;

a filter supported within said opening; and a perforated screen disposed in said opening below said filter, a perforated peripheral edge of said screen forming an upwardly extending perforated flange;

wherein said perforated flange, in association with a side wall of said cross member, forms an inclined air channel for directing an air stream into a vortex formed below said cross member and flushing said vortex to remove particulate contaminants, said flange being configured to permit air to pass through said flange and into said air channel.

20. The ceiling structure of claim 19 further including said cross member defining an interior space, a light fixture disposed within said interior space, and a gel track mechanically associated with said cross member, said gel track being positioned elevationally below said light fixture, wherein said filter includes a sealing edge positioned in said gel track.

21. A ceiling structure for cleanroom comprising:

a grid support structure including an integral cross member, said integral cross member including two downwardly extending legs, said legs being spaced apart from one another, a lower end of each leg being formed into a generally "U"-shaped track, each said track containing a quantity of gel, a bottom surface of each "U"-shaped track being positioned co-planar with a bottom surface of said grid support structure; and a filter having a sealing edge positioned in said gel.

22. The ceiling structure of claim 21 further including a perforated screen disposed below said filter in an opening defined within said grid support structure, said screen having a vertically inclined, peripheral edge, which forms an inclined air channel in association with an exterior sidewall of one said "U"-shaped track.

23. The ceiling structure of claim 22, wherein said vertically inclined peripheral edge defines a plurality of perforations which permit air to pass through said vertically inclined peripheral edge and into said air channel.

* * * * *